United States Patent [19]

White

[11] Patent Number: 4,805,702

[45] Date of Patent: Feb. 21, 1989

[54] METHODS AND APPARATUS FOR ROCK DUSTING MINE TUNNELS

[75] Inventor: Earl R. White, Price, Utah

[73] Assignee: Utah Power & Light, Salt Lake City, Utah

[21] Appl. No.: 132,991

[22] Filed: Dec. 15, 1987

[51] Int. Cl.[4] ..... A62C 3/00

[52] U.S. Cl. ..... 169/64; 169/45; 299/12; 239/654; 239/752

[58] Field of Search ..... 169/64, 45, 48, 52, 169/91; 299/12; 239/77, 78, 654, 752, 750

[56] References Cited

U.S. PATENT DOCUMENTS

| | | | |
|---|---|---|---|
| 1,556,879 | 10/1925 | Reid . | |
| 1,578,628 | 3/1926 | Beatty . | |
| 1,764,113 | 6/1930 | Miller . | |
| 1,862,396 | 6/1932 | Gray et al. | 169/64 |
| 2,521,888 | 9/1950 | Wilson | 169/64 |
| 2,759,293 | 8/1956 | Weller . | |
| 3,194,443 | 7/1965 | Gurney . | |
| 4,394,975 | 7/1983 | Bare, Jr. et al. | 239/654 |
| 4,538,941 | 9/1985 | Thorne | 406/153 X |

*Primary Examiner*—Joseph F. Peters, Jr.

*Assistant Examiner*—James M. Kannofsky

*Attorney, Agent, or Firm*—Workman, Nydegger & Jensen

[57] ABSTRACT

The present invention relates to methods and apparatus for dispersing rock dust within a mine tunnel. The present invention is particularly useful for rock dusting coal mines. A quantity of rock dust is dispersed evenly over the conveyor system which runs through the area of the mine which requires dusting. The apparatus of the present invention comprises a wheeled vehicle having a diesel engine which drives the vehicle. In addition, the diesel engine drives a blower or fan. The vehicle of the present invention is adapted to run along the conveyor system within the mine. As a result, the vehicle runs over the rock dust which is dispersed on the conveyor belt. As the vehicle passes over the rock dust the fan which is associated with the vehicle blows into the rock dust causing the rock dust to disperse from the conveyor belt and to coat the associated interior tunnel. The vehicle of the present invention includes an apparatus for directing the flow of air in such a direction that rock dust leaves the surface of the conveyor in the desired direction.

40 Claims, 3 Drawing Sheets

METHODS AND APPARATUS FOR ROCK DUSTING MINE TUNNELS

BACKGROUND

1. The Field of the Invention

The present invention is related to methods and apparatus for spreading rock dust in mine tunnels in order to prevent fires and explosions. More particularly, the present invention is related to methods and apparatus for rock dusting mine tunnels, which apparatus is self-propelled and is capable of traveling along the top of a conventional mine conveyor system.

2. The Background of the Invention

It is well known that fires and explosions are a major hazard in the field of underground mining. The danger of fire and explosion is particularly acute in coal mining because of the existence of inherently explosive and flammable materials, such as methane gas and coal dust, in the underground coal mine. The history of underground coal mining in the United States and in other countries of the world has been punctuated by frequent fires and explosions. Associated with such fires and explosions is the almost certain loss of life and personal injury which flows from such occurrences. For example, it is estimated that from 1980 through 1984, over 53,000 miners were injured and over 450 miners lost their lives in coal mine accidents, many as a result of fire or explosion. See *Statistic Abstract of the United States* at 680 (1987).

The cause of such fires and explosions can be readily appreciated. Combustible materials are generally associated with the mining of materials, such as coal, which are based on organic chemicals. Not only is the coal itself is combustible, but the mining operation produces small fragments of coal and coal dust which is introduced into the air. This material may well be combustible and even explosive under appropriate conditions.

As mentioned above, it is also well known that hydrocarbon gases are found in association with coal mine operations. The most commonly found gas is methane gas, the major component of natural gas. Other similar combustible hydrocarbon gases are also found in lesser quantities in association with coal mines. It will be appreciated, therefore, that the gaseous materials which are released during coal mine operations are themselves extremely hazardous.

It will also be appreciated that coal mine operations can often result in sufficient sparks to ignite combustible and explosive materials. Coal mine operations require the use of many types of electrical apparatus as well as other types of machinery which can potentially produce sparks. The combination of spark-producing machinery and electrical equipment, and the extremely explosive and combustible coal dust and related gases, produces a hazardous situation.

the combination of potentially spark producing equipment and extremely combustible material found within underground mines has resulted in disaster on many occasions. In addition, underground explosions and fires are particularly difficult to survive. For example, the explosion may cause collapse of part of the mine tunnel. Fire and explosion underground produces large quantities of noxious gases which can easily produce personal injury or death to underground miners and others working underground. Thus, it can be seen that fires and explosions in underground mine operations are of particular concern to all involved.

Various solutions have been attempted in order to prevent fire and explosion in underground mine operations. One traditional method of minimizing the potential for fire and explosion has been to spread inert material within the interior of the mine. In some cases it is desirable to totally coat the interior walls, ceiling and floor of the mine tunnels. Adding inert material to the environment helps to maintain the ambient atmosphere within the mine at conditions which are not explosive or combustible. The inert materials spread onto the interior walls of the mine sufficiently dilutes the mine dust and methane within the mine such that the atmosphere is not capable of propagating an explosion or fire. The coating also helps prevent further coal dust and the like from escaping into the air within the mine tunnel.

This method of preventing explosions and fires within the mine has become accepted in the art. Indeed, under regulations promulgated pursuant to the Federal Coal Mine Health and Safety Act, dusting is now a requirement in many mines.

Regulations of the Mine Safety and Health Administration ("MSHA") provide that the interior of coal mines and the like should be coated with a coating of "rock dust." Rock dust is defined by MSHA as pulverized limestone, dolomite, gypsum, anhydrite, shale, adobe, or other inert material, preferably light colored, 100 percentum of which will pass through a sieve having 20 meshes per linear inch and 70 percentum or more of which will pass through a sieve having 200 meshes per linear inch. See 30 C.F.R. §29.4 (1986).

MSHA also sets forth regulations concerning the use and spreading of "rock dust." These regulations require the use of rock dust in many situations. In particular, those regulations state that:

> All underground areas of a coal mine, except those areas in which the dust is too wet or too high in incombustible content to propagate an explosion, shall be rock dusted to within 40 feet of all working faces, unless such areas are inaccessible or unsafe to enter or unless the Secretary or his authorized representative permits an exception upon his finding that such exception will not pose a hazard to the miners. All crosscuts that are less than 40 feet from a working face shall also be rock dusted. 30 C.F.R. §75.402 (1986).

Obviously, extensive governmental regulations governing the use and administration of rock dust are now in place. Furthermore, the situations in which rock dust is required are also defined in detail by specific regulation. Thus, it can be seen that mine operators now find themselves in the position of being required to comply with extensive regulation regarding rock dusting. Rock dusting within coal mines, therefore, is often no longer just one alternative to dealing with potentially hazardous conditions, but rather, is absolutely required in many settings.

As a result of the safety hazards presented by explosive materials in a mine, as well as the requirements of federal statute and regulation, methods and apparatus for rock dusting are of prime importance in coal mine operations. Various methods and devices have been developed to allow the spread of rock dust.

One of the early methods of rock dusting coal mine operations was simply to provide a powerful blower at the entrance of a tunnel. The blower would blow shale rock or similar substances into the mine. The problem with this method, however, was that a great many places within the mine remained unprotected from coal dust explosions. The single fan at the entrance of the tunnel could not provide sufficient thrust to drive rock dust into every corner of the mine. In addition, this method was found to be very uneconomical because of the large size and expense of the machinery necessary, as well as the labor cost in operating the machine and in feeding coal dust into the machine. In addition, it was generally necessary to close the mine to allow for the application of rock dust.

An improvement on the method of simply blowing dust into a mine, was to introduce that dust in liquid form. Using this method, the powdered shale, clay, adobe, or other similar inert material was mixed with water in a large tank to form a thick fluid or paste. This fluid or paste was them pumped through a centrifugal pump and was sprayed onto the walls of the mine tunnel. In liquid form, the dust was able to penetrate many areas which were missed by simply blowing dust into the mine.

This method, however, suffered from several drawbacks. First it was necessary to provide a large source of water at the mine. Depending on the location of the mine, this could be extremely difficult. Also, compared with dry rock dust, the wet paste is heavy and difficult to handle. Thus, this method was also found to be expensive and difficult to implement.

In order to provide some mobility in using rock dusting methods, it was often desirable to provide a truck frame and wheels on which to mount the sprayer apparatus. In some cases, the truck was provided with railroad-type wheels such that the apparatus could be moved about on the tracks which otherwise accommodated mine cars within the mine. This provided some additional mobility and flexibility, yet many of the problems described above still remained. The dusting operations remained difficult and expensive. In addition, limitations inherent in carrying a supply of rock dust are encountered. For example, frequent reloading of the hopper is required.

Another device of this general type employed a hopper of dry dust set on top of a truck having railroad type wheels. The apparatus included a screw conveyor which unloaded the hopper into the actual sprayer device. The dust was then pumped into a fan, or other type of pumping device from which it was sprayed onto the mine walls. This device, while an improvement over some of the early devices, still suffered from several limitations. For example, the size and weight of the hopper limited the flexibility of the device. Overloading the hopper required the movement of heavy loads of rock dust. If the hopper is too small or insufficiently loaded, however, the hopper must be frequently refilled.

Various adaptations of this general concept have been made. Essentially, a trough or holding container is provided to hold a supply of mine dust. A feed mechanism is then placed in communication with the trough such that the rock dust can be moved out of the trough. The feeding mechanism then feeds the rock dust into a blower mechanism, which in turn allows the rock dust to be manually blown onto the various walls, ceilings, and floors of the mine. Often the wheels are of a type such that they are adapted to fit on the rails which run within the interior of the mine. This provides a certain measure of mobility which otherwise would not be available to a machine of the weight and size of conventional rock dusters. However, the limitations described above remain.

Other modifications to this type of machinery have been made. For example, the exact configuration of the fan mechanism has been varied somewhat. One such rock duster employs a centrifugal broadcasting member whereby dust is discharged from the apparatus and sprayed onto the interior of the mine. Additional fans and other feeding apparatus have been provided in order to prevent the rock dust from packing within the trough. In each of these variations, however, the same basic concept is applied. The apparatus comprises a hopper of limited size, which may be mounted on a mobile truck body. The contents of the hopper are then fed into a sprayer mechanism for discharge into the interior of the mine.

It is clear that one of the major problems in this type of apparatus is the transportation of rock dust within the mine. Each of these mobile sources suffer from the problem of requiring that the apparatus itself transport a supply of rock dust. Once the supply of rock dust is depleted the device must again return to the outside of the mine, or other location, where an additional supply of rock dust can be found.

In order to partially solve this problem, it has been suggested that a conveyor system be used to convey rock dust to the mobile apparatus. Thus, an apparatus having a trough or storage bin and a blower mechanism has been devised. In order to fill the trough, however, it has been suggested that the conveyor belt within the mine be used to deliver rock dust to a more convenient location in order to load the hopper on the apparatus.

While this partially solves the problem, the same basic problem exists as with the other mobile apparatus. IT is still necessary to constantly fill the trough or storage bin during use. The conveyor belt simply provides a more conveniently located stock pile of rock dust. It is still necessary to return to the source of rock dust, (such as the end of the conveyor belt) in order to fill the apparatus. Alternatively, if the bin were to be placed in communication with the end of the conveyor, the apparatus would have extremely limited mobility and usefulness.

It is apparent that what is currently needed in the art are methods and apparatus for easily and effectively applying rock dust within underground mines, such that complete coverage of mine floors, ceilings, and walls is provided. It would also be an advancement in the art to provide such an apparatus where no heavy and bulky hopper was required and, as a result, frequent reloading would not be needed. It would also be an advancement in the art to provide methods and apparatus for applying rock dust which wee mobile and which used independent means of propulsion. It would also be an advancement in the art to provide methods and apparatus for applying rock dust which were not bulky and complex, as are conventional rock dust applicators. It would also be an advancement in the art to provide methods and apparatus for applying rock dust which were economical to use and which did not require closing the mine for extended periods of time.

Such methods and apparatus are disclosed and claimed below.

BRIEF SUMMARY AND OBJECTS OF THE INVENTION

The present invention relates to methods and apparatus for applying rock dust within a tunnel, such as an underground coal mine. The present invention overcomes the limitations of the art as outlined above. The apparatus of the present invention is mobile, yet extremely effective in spreading rock dust within a mine tunnel. The present invention provides the mine operator with the ability to meet all applicable safety standards in an extremely economical manner.

The present invention comprises a spreading apparatus which may preferably travel along the existing conveyor system within a mine tunnel. Prior to introducing the apparatus into the mine tunnel, the conveyor system is coated with rock dust. This may be accomplished by running the conveyor system and loading rock dust onto the conveyor system as it runs. The conveyor system is run until the rock dust first loaded onto the conveyor system reaches the end of the conveyor system. At this point the conveyor system is stopped. Thus, the conveyor system is left at rest being evenly covered with rock dust.

The spreader apparatus of the present invention is then placed on the conveyor belt at any desired location. As will be discussed in further detail below, the apparatus of the present invention includes means for causing the rock dust on the conveyor system to be spread onto the interior walls of the mine tunnel.

The apparatus of the present invention comprises a frame which rides on a plurality of wheels. In one embodiment, the frame rides on three wheels. These wheels include a single front wheel and two rear drive wheels. Alternatively, the apparatus of the present invention could have four wheels. The four-wheeled apparatus would again have two rear drive wheels, but would have two front wheels for use in steering the apparatus and maintaining the apparatus on the conveyor system.

Also attached to the frame are means of propelling the apparatus. It is presently preferred that propulsion be provided by a diesel engine. The power generated by the diesel engine is then transmitted to the drive wheels through a conventional transmission mechanism comprised of belts or gears.

A diesel engine accomplishes the various objects and objectives of the present invention. Diesel engines are generally approved for use in mines in that they are not likely to cause sparks which will initiate explosions or fires within the mine. At the same time, the diesel engine allows the apparatus to travel freely within the interior of the mine tunnel. Alternatively, an electric motor could be used. An electric motor, however, suffers from the requirement of connecting the electric motor to a source of electricity. This requirement may limit the mobility of the apparatus.

As mentioned above, the present invention also comprises a transmission for placing the drive wheels in communication with the engine. The transmission may comprise any type of conventional transmission, gear box, series of belts, and the like. Also attached to the transmission are means for placing the transmission mechanism into gear and taking the transmission mechanism out of gear. This may simply be a shift lever along the side of the apparatus which is in communication with a conventional clutch mechanism, or in the alternative, it may include an elongated cord attached to a switch box having electronic controls. A further method of switching the apparatus on and off is a radio remote control so that the apparatus can be controlled from a distance.

Another important feature of the present invention is a blower means. The blower means is preferably placed behind the engine. By mounting the blower apparatus behind the engine, it is possible to direct rock dust away from the engine and thus minimize the amount of rock dust entering the engine, and corresponding engine damage and maintenance.

The blower means provides a mechanism whereby air can be directed downwardly onto the loaded conveyor belt holding the rock dust. The air so directed picks up the rock dust and blows it off of the conveyor belt onto the walls, ceiling, and floor of the mine tunnel.

The blower means may comprise any type of typical blower. For example, the blower means may simply comprise a high powered fan. In the alternative, the blower may comprise an auger similar to that typically used in snow blowing apparatus. The blower means may also comprise a scoop which scoops rock dust into a flinger apparatus.

Also associated with the blower means may be air deflectors of various types. For example, the air deflectors may direct the air exiting the blower means in a particular desired direction. Thus, the air can be directed downwardly, or at an angle, depending on the effect desired.

As can be appreciated from the above description, the present invention is able to operate with no hopper and is, therefore, extremely mobile and flexible in use. The conventional conveyor system already in place within a mine tunnel is used in place of a heavy and cumbersome hopper or other similar supply source.

In operation, the apparatus of the present invention is extremely mobile and is able to travel along the top of the conveyor. The apparatus is configured such that the wheels ride within the trough formed by the conveyor belt. At the same time, the blower blows air rapidly from the rear of the apparatus. As a result, as the apparatus travels along a section of conveyor, the rock dust which is in place on the conveyor is blown onto the walls, ceiling, and floors of the interior of the mine tunnel. Thus, a continuous source of rock dust is available without the necessity of carrying the rock dust on the apparatus and reloading a hopper.

The present invention overcomes many of the problems associated with the prior art. The present invention is operated with a minimum of manpower. Rock dusting of a mine can occur rapidly with no need to close the mine for an extended period of time. At the same time the present invention is very effective and allows the mine operator to strictly comply with all applicable rock dusting requirements.

It is, therefore, a primary object of the present invention to provide methods and apparatus for effectively spreading rock dust within the interior of a mine tunnel.

It is a related object of the present invention to provide methods and apparatus which are effective in spreading rock dust into all areas within a mine tunnel, even areas which are difficult to reach using a conventional apparatus.

It is another object of the present invention to provide methods and apparatus for spreading rock dust which do not require the use of a hopper, storage container, or other similar device for storing rock dust and which does not require frequent reloading of such hopper or similar device.

It is a related object of the present invention to provide a self-propelled rock dusting apparatus.

It is also an object of the present invention to provide methods and apparatus for spreading rock dust which apparatus is extremely mobile and which may be used in all areas of the mine without producing dangerous sparks or other types of fire hazards.

It is another object of the present invention to provide methods and apparatus for spreading rock dust wherein the apparatus is not bulky or complex, as are typical conventional apparatus.

These and other objects of the invention will become apparent upon reading the following detailed description and appended claims, and upon reference to the accompanying drawings.

DETAILED DESCRIPTION OF THE PREFERRED EMBODIMENTS

The present invention can be best understood with reference to the drawings, wherein like numerals designate like parts throughout. The present invention is related to an apparatus for spreading rock dust within an underground mine tunnel. In addition, the present invention is related to methods of operation and use of the apparatus, including methods for rock dusting a mine tunnel.

As will be appreciated from the discussion above, rock dusting is an extremely important procedure in the mining industry. Rock dusting has, indeed, been designated by statute and regulation in the United States as a preferred method for preventing explosion and fire in underground mine tunnels.

Figure 1:
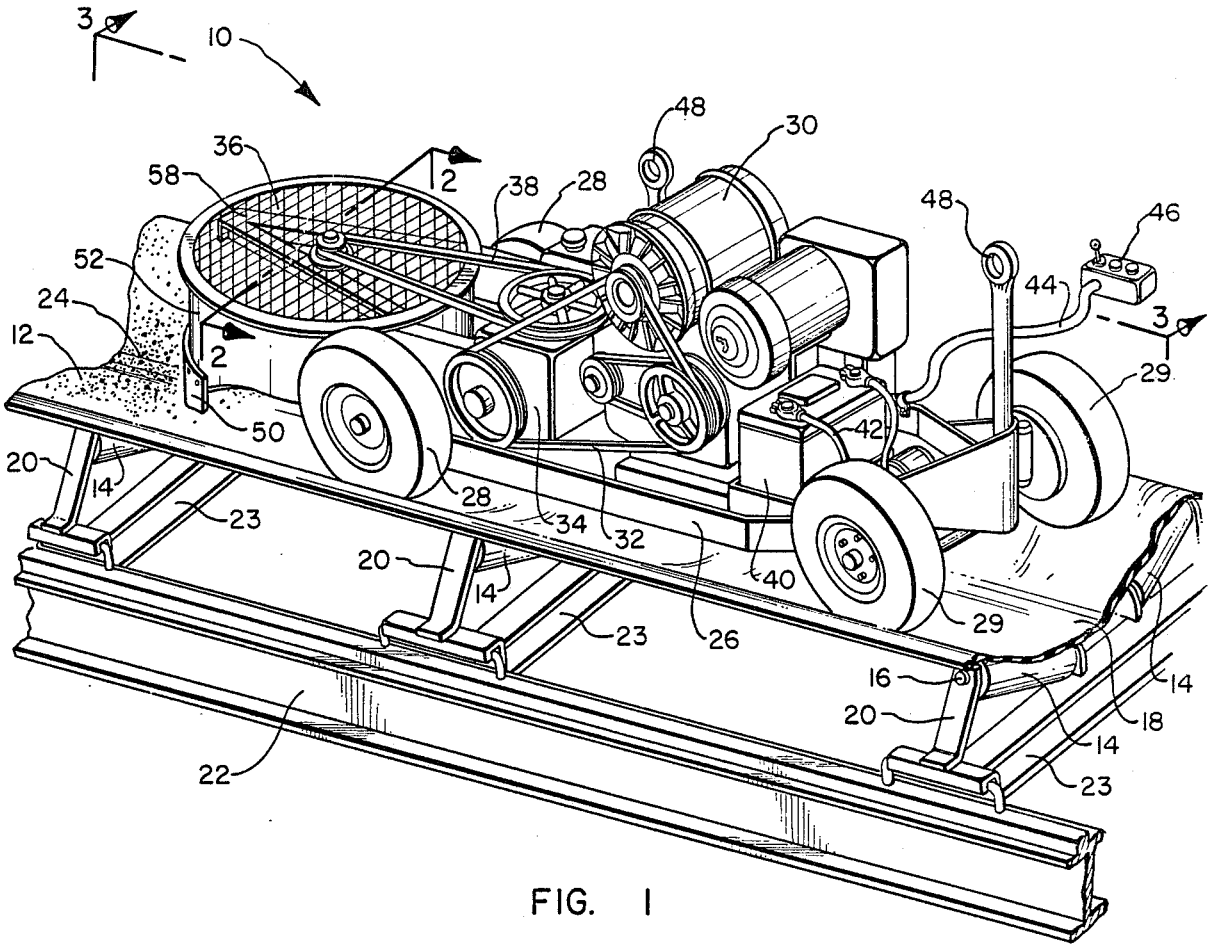
FIG. 1 is a perspective view of one embodiment of the apparatus of the present invention in place on a mine conveyor.

One embodiment of the rock dusting apparatus of the present invention is illustrated in FIG. 1 and is designated generally with the numeral 10. The present invention operates without the need of a hopper, storage bin, or other similar type of storage apparatus in order to transport rock dust into the mine for distribution by the apparatus 10. The present invention, conversely, teaches the use of a bed of rock dust evenly distributed on the conveyor system already existing within the interior of the mine tunnel.

FIG. 1 illustrates a conventional conveyor system. The conveyor includes a conveyor belt 12. The conveyor belt 12 rests on a plurality of tilted idlers 14. Idlers 14 are generally cylindrical in shape being provided with an axle 16 through the interior of the idler 14. The axle 16 and the idler 14 are constructed so that the idler 14 is free to rotate as necessary around axle 16.

As can be appreciated with reference to FIG. 1, the idlers 14 are installed within the conveyor system at somewhat of an angle above the horizontal. The angle of the various idlers is chosen in order to maximize the efficiency of operation of the conveyor belt. The conveyor belt rests on the tilted idlers, forming a trough, generally designated 18, in the center of the conveyor belt.

The idlers 14 are installed and held in place using a plurality of conventional braces 20. The braces 20 simply attach the idlers 14 to the remainder of the conveyor belt apparatus and maintain the idlers 14 at the appropriate angle. The conveyor belt apparatus also includes a plurality of elongated rails 22 which are attached to the braces, and in turn to the idlers 14. The elongated rails provide support for the conveyor system. In addition, the conveyor system may include various other arts to allow it to rest at a particular height within the interior of the mine tunnel.

In operation, the conveyor belt 12 of the conveyor system is coated with a layer of rock dust generally designated 24 in FIG. 1. Coating the conveyor belt 12 with the layer of rock dust is a relatively simple matter involving operating the conveyor belt such that it passes from the exterior of the mine into the interior of the mine. As the conveyor belt is operating in this manner, rock dust is distributed onto the conveyor belt from a central source of rock dust. This process continues until the entire subject area of the conveyor belt is evenly coated with rock dust to the desired depth. Once the subject area is fully coated with rock dust 24, the operation of the conveyor belt ceases. Thus, the result is an appropriate layer of rock dust spread over the entire length of the conveyor belt within the subject area of the mine tunnel.

The use of this method to transport rock dust into the interior of the mine eliminates the need to attach a bulky hopper, storage bin, or other similar type of apparatus to the apparatus 10. This is true because of the fact that the necessary rock dust has already been distributed evenly on top of the conveyor belt 12.

FIG. 1 also illustrates one embodiment of the apparatus 10 of the present invention. As can be appreciated from FIG. 1, one method of use of the apparatus 10 of the present invention is to place the apparatus 10 on top of the loaded conveyor belt 12. The apparatus 10 is specifically configured so that it is able to drive along the top of the conveyor belt 12 and perform its rock dusting function. The use of the apparatus 10, however, is not limited to operation in conjunction with the conveyor belt 12. For example, it may be possible to place a layer of rock dust on the mine floor for distribution by the apparatus 10.

The basic structural feature of the apparatus 10 is a frame 26. The frame 26 may be made of any preferable type of material which is sufficiently strong and flexible to accommodate the device 10. In particular, a steel frame may be preferred. Alternatively, lightweight material such as aluminum may be used where appropriate.

Attached to the frame 26 are a plurality of wheels. The wheels include drive wheels 28 and front wheels 29. In the embodiment of the device illustrated in FIG. 1, the apparatus 10 comprises four wheels. Alternatively, as will be discussed below with reference to FIG. 5, the apparatus may comprise three wheels.

The wheels 28 and 29 of the present invention are attached to the frame 26 in such a manner that the apparatus 10 can easily rest on the top of the conveyor belt 12. It is presently preferred to attach the wheels 28 and 29 to the frame 26 in such a manner so as to provide the device with a relatively low center of gravity when the apparatus 10 is placed on top of the conveyor belt 12. This provides for additional stability and ease of operation of the apparatus Front wheels 29 will include means for steering the apparatus 10. One method for steering the apparatus 10 is to attach wheels 29 in such a manner that they are able to turn in response to changes in the direction of the path of the conveyor belt. This can be accomplished by attaching wheels 29 as "castor" wheels such that they turn freely. Alternatively, steering may be accomplished by attaching wheels 29 using an axle which is easily turned. Alternatively, wheels 29 may be attached to any other type of conventional steering mechanism.

Also attached to the frame 26, as illustrated in FIG. 1, is a diesel engine generally designated 30. The diesel engine 30 may be mounted onto the frame 26 in any acceptable and conventional manner. It is only necessary that the diesel engine be firmly attached to the frame 26 in such a position as to allow the diesel engine to drive the various components of the apparatus.

It will also be appreciated that diesel engine 30 is a presently preferred type of engine for use in underground mining. Diesel engines have been approved by various governmental agencies for use underground. Diesel engines are found to be relatively safe and are unlikely to spark an explosion, fire, or other type of dangerous situation in an underground mine such as a coal mine.

The output of the diesel engine 30 is translated into power for operation of the apparatus through a plurality of belts, gears, or other types of transmission mechanism. In the embodiment illustrated in FIG. 1, the drive output of the diesel engine 30 is translated into power for the apparatus through a plurality of belts and gear mechanisms including drive belt 32. Drive belt 32 is placed in communication with a gear box 34. The gear box 34 allows the rotational energy driven from the diesel engine 30, through drive belt 32, to be communicated to the various parts of the apparatus which need to be driven.

The gear box 34 is placed in communication with the rear drive wheels 28. The wheels 28 become drive wheels to propel the apparatus 10 along the conveyor belt 12. As mentioned above, the method of placing the rotational force of the diesel engine 30 in communication with the drive wheels 28 may be any conventional method. Any type of gear mechanism, belt drive mechanism, or other type of drive mechanism would be acceptable for use within the scope of the present invention.

Also illustrated in FIG. 1 is a blower mechanism 36. The blower mechanism 36 is also driven by the power generated by the diesel engine 30. The blower mechanism may be operated by any number of gears, belts, or other similar types of drive mechanism. As illustrated in FIG. 1, the blower mechanism is driven by belt 38. Belt 38 is in communication with the blower mechanism 36 at one end and with the gear box 34 at the other end. Thus, the power generated by the diesel engine 30 can easily be transmitted to both the blower mechanism 36 and the drive wheels 28.

Other conventional components of a diesel engine are also illustrated in FIG. 1. In addition, the battery 40 and battery cables 42 are shown.

Also incorporated into the apparatus 10 will be means for placing the apparatus 10 into gear and removing the apparatus from gear. Thus, the apparatus can be controlled easily in its movement. The control means for placing the apparatus into gear and taking the apparatus out of gear may be a gear shift lever, or levers, attached to the gear box, or other mechanism associated with the apparatus 10. Alternatively, and as illustrated in FIG. 1, a cable 44 may place the apparatus 10 in communication with control box 46. Control box 46 allows the operator to selectively place the drive wheels 28 into gear or to take the drive wheels 28 out of gear. In addition, the control box 46 will allow the operator to place the blower mechanism 36 into gear, or to take the blower mechanism 36 out of gear. Thus, complete control over the apparatus is provided to the operator.

As an additional mechanism for controlling the apparatus 10, it is possible to provide the apparatus 10 with a radio remote control. Thus, the operator would not necessarily be required to remain directly adjacent to the apparatus 10 as it is rock dusting the interior of the mine tunnel.

Also illustrated in FIG. 1 are a pair of lifting hooks 48. Lifting hooks 48 are provided in order to allow the operator greater control over the apparatus 10. For example, the front lifting hook may be attached to another drive mechanism such that the apparatus 10 may be towed. Both lifting hooks 48 may be used to lift the apparatus 10 onto and off of the conveyor belt 12. Thus, the apparatus is easily operated by a limited number of personnel using very conventional equipment.

Also illustrated in FIG. 1 is an air dam 50. The air dam 50 is attached to the front portion of the blower mechanism 36. The air dam 50 is shaped in order to direct the flow of air, and thus rock dust, from the surface of the conveyor belt 12. The method of operation of the air dam 50 will be discussed in further detail below.

In summary, FIG. 1 discloses one embodiment of the apparatus 10 of the present invention. As can be seen from FIG. 1, the apparatus 10 rests securely on top of the conveyor belt 12. Indeed, the apparatus 10 is constructed so that it fits within the trough 18 of the conveyor belt 12. This serves to maintain the apparatus 10 securely on top of the conveyor belt 12 while operation of the device occurs. In addition, the manner in which the apparatus 10 fits within trough 18 provides means for steering the apparatus 10 by causing wheels 29 to turn.

Figure 2:
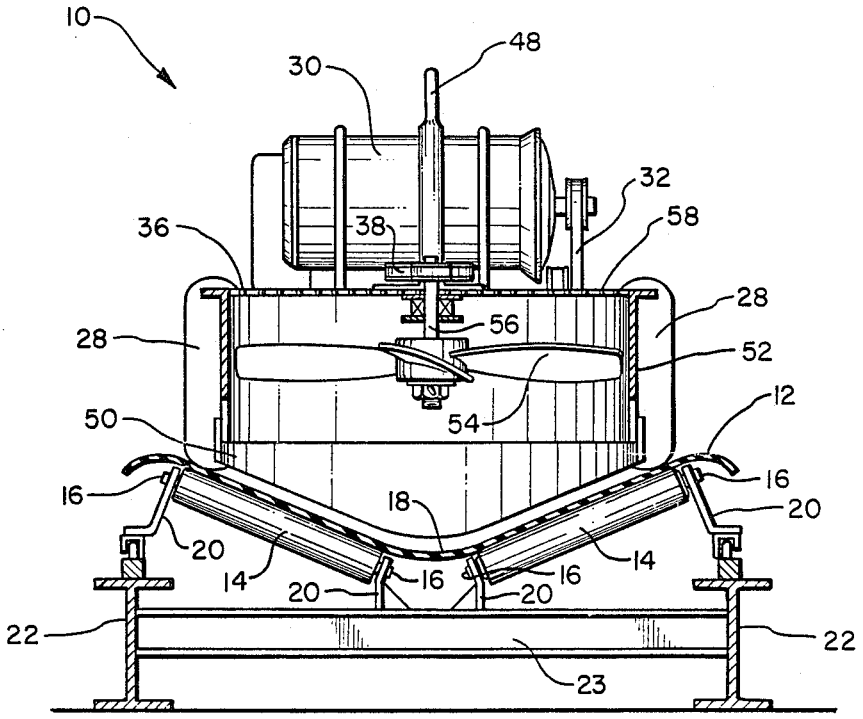
FIG. 2 is a transverse cross-sectional view along line 2—2 in FIG. 1 illustrating the fan or blower means of the apparatus in relation to the mine conveyor.

The structure and operation of the present invention can be more fully appreciated with reference to FIG. 2. FIG. 2 is a transverse cross-sectional view illustrating the fan and blower mechanism 36 within the apparatus 10 illustrated in FIG. 1. FIG. 2 is a cross section taken along line 2—2 shown in FIG. 1. In FIG. 2, the conveyor belt 12, and related conveyor mechanisms are shown in cross section. Also shown in additional detail are conveyor supports 23 which support the idler mechanisms and which tie together rails 22. FIG. 2 further illustrates the diesel engine 30 along with the drive belt 32 and the belt 38.

Shown in more detail in cross section in FIG. 2 is the blower housing 52. Blower housing 52 is configured as necessary to aid in directing the flow of air through the apparatus 10 in such a manner as to carry the rock dust 24 in the directions desired.

Also shown within the interior of the blower mechanism 36 is the fan blade 54. Fan blade 54 is placed in communication with belt 38 through shaft 56. It will be appreciated that as the belt 38 rotates, being driven by diesel engine 30, shaft 56 will in turn be rotated. The rotation of shaft 56 causes the rotation of fan blade 54. As a result, rotation of fan 54 causes a flow of air through the apparatus.

The flow of air through the apparatus enters the apparatus from above the apparatus through screen 58. Screen 58 is placed above fan blade 54 in order to prevent injury caused by an operator reaching into the rotating fan blade 54. In addition, the screen 58 will protect the fan blade 54 from damage in that large pieces of debris will be prevented from falling into the blower mechanism 36.

Also illustrated in FIG. 2 is air dam 50. As can be seen from the cross-sectional illustration in FIG. 2, air dam 50 protrudes into trough 18 formed by conveyor belt 12. The air dam 50 limits the amount of air flow out of the blower mechanism 36 in directions other than to the side of the conveyor belt 12. Thus, the primary thrust of air flow through the blower mechanism 36 will be upwardly and outwardly from the conveyor mechanism.

Figure 3:
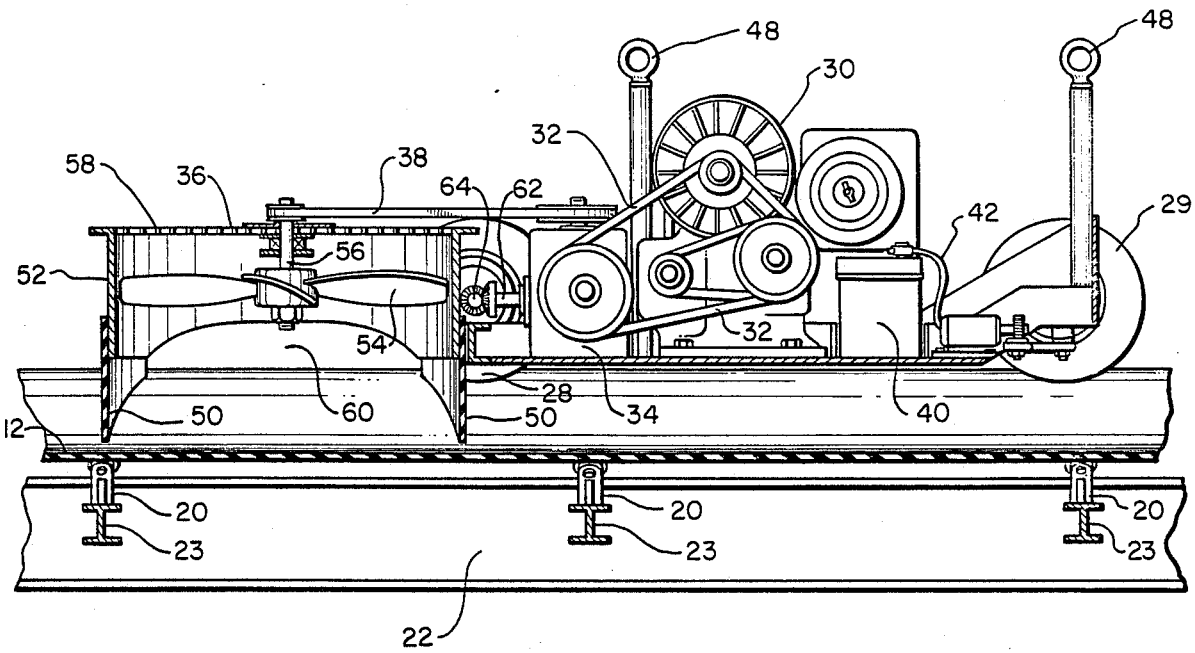
FIG. 3 is a longitudinal cross-sectional view illustrating the device illustrated in FIG. 1 in relation to the mine conveyor.

Reference is now made to FIG. 3 wherein the device is shown in a longitudinal cross-sectional manner. Again, the various wheels 28 and 29 are illustrated, as is the diesel engine 30 and the associated belts 32 and 38. Shown in longitudinal cross-sectional manner in FIG. 3 is the blower mechanism 36.

It will be appreciated from FIG. 3 that belt 38 places the shaft 56 in communication with the gear box 34. Gear box 34 is, in turn, placed in communication with diesel engine 30 such that the power produced by the diesel engine can be communicated to the shaft 56. Shaft 56 is then, in turn, securely attached to fan blade 54. As had been discussed previously, fan blade 54 is included within blower housing 52 and is covered by screen 58. Thus, the fan is essentially enclosed on all sides so that debris does not enter the fan and such that the apparatus 10 is safe to operate.

In operation, air flows into the device from above the device through screen 58. The air is driven downwardly by fan blade 54 where the air contacts the layer of rock dust 24 which is laid on conveyor belt 12. Specifically, the air flows out of openings 60 which are formed in the side walls of blower housing 52.

Also illustrated in FIG. 3 is one embodiment of the drive mechanism of the drive wheel 28. Drive shaft 62 protrudes from gear box 34. Drive shaft 62 is then placed in communication with the axle 64 which runs between the two drive wheels 28. By a differential mechanism or other type of conventional linkage, the drive shaft 62 communicates its rotational energy to the axle 64 in order to turn the drive wheels 28.

Figure 4:
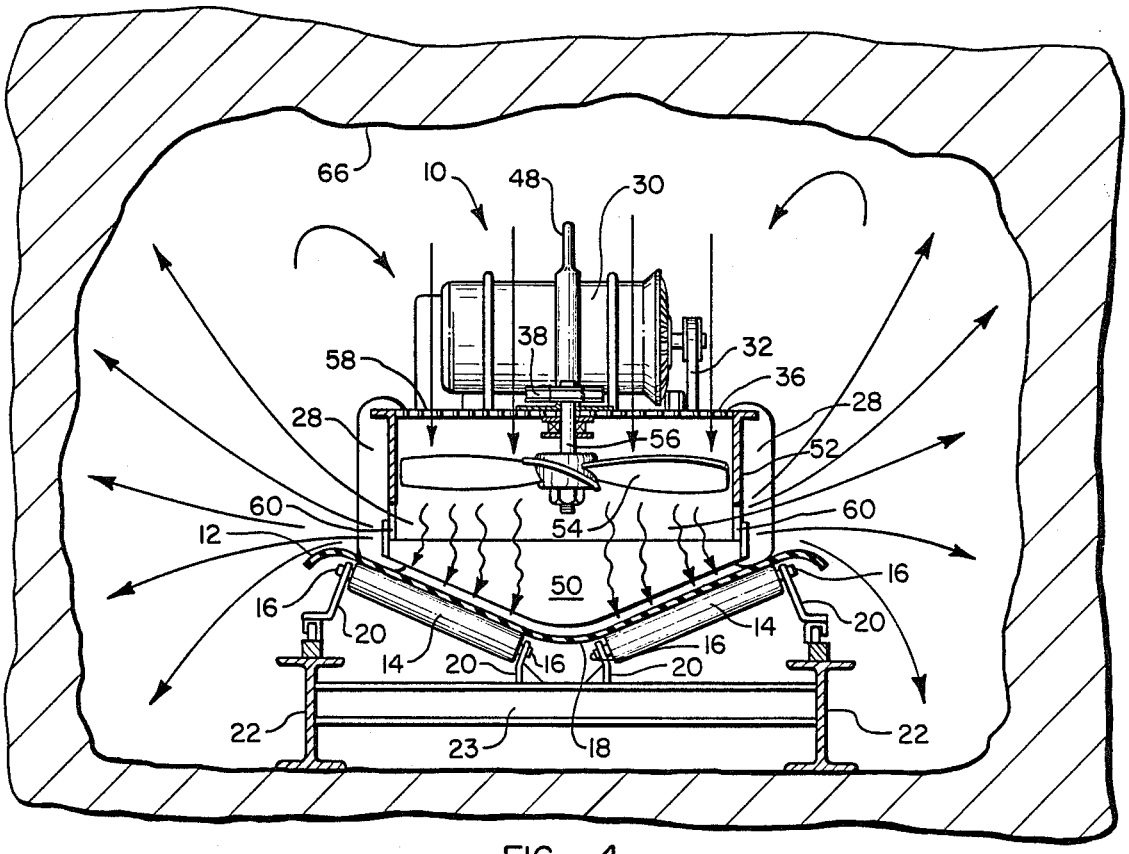
FIG. 4 is a transverse cross-sectional view of the fan device in operation showing the route of travel of the air and rock dust.

The precise method of operation of the apparatus 10 can be more fully appreciated with reference to FIG. 4. FIG. 4 is a transverse cross-sectional view similar to the view shown in FIG. 2. FIG. 4, however, illustrates the fan mechanism as it is in operation. The flow of air and rock dust through the device can be more fully appreciated with reference to FIG. 4. As fan blade 54 is rotated, air from above the device 10 is drawn downwardly through screen 58. The air then comes into contact with fan blade 54, or the area around fan blade 54, and is accelerated downwardly toward the conveyor belt 12.

Lying on top of the conveyor belt 12 is a layer of rock dust 24. Thus, the air which has been driven downwardly by the fan blade 54 mixes with the layer of rock dust. The mixed air and rock dust stream is then forced upwardly and outwardly from the conveyor belt 12 because of the shape of trough 18. The flow of the stream of air and rock dust exits the blower housing 52 through opening 60 as is shown by the outwardly extending arrows in FIG. 4. In addition, air dam 50 prevents the flow of air from exiting toward the back or front of the blower mechanism 36. As the air and rock dust stream contacts the walls 66 of the mine tunnel, rock dust is spread on the walls 66. The air previously carrying the rock dust is then available to be drawn through the blower mechanism 36 once again.

It will be appreciated that the various characteristics of the blower mechanism 36, including the configuration of fan blade 54 and the speed of operation of the fan blade will be carefully chosen in order to produce an acceptable and desirable stream of air. Thus, the rock dust and air stream which is created by the process described above will exit the device and flow toward the walls of the mine tunnel 66, coating the mine tunnel 66 with sufficient rock dust to satisfy necessary safety requirements.

The apparatus is driven forward by the diesel engine 30 through the gear box 34 and the drive line to the drive wheels 28. Thus, the apparatus 10 will move in a forward direction (that is, in a direction such that the blower mechanism 36 becomes the rear of the apparatus 10).

A constant supply of rock dust is available when employing the present invention. The supply of rock dust will have already have been laid onto top of the conveyor belt 12 in the preloading step described above. It is, therefore, not necessary to provide the apparatus with a constant bulk supply, such as by constantly reloading a hopper attached to the device. This results in ease and speed of operation. Indeed, rather than closing the subject area of the mine for several hours to rock dust, as is the case using conventional devices, it may be possibly to rock dust various sections during or between shifts.

The manpower needed to dust the interior of a mine tunnel is substantially reduced when using the present invention. Only a single operator need be used to run the device 10. In addition, it is not necessary to provide additional manpower to keep the rock dusting machine supplied, as is the present practice. Thus, the present invention provides a simple, effective, and inexpensive apparatus and method for rock dusting the interior of underground mines.

Figure 5:
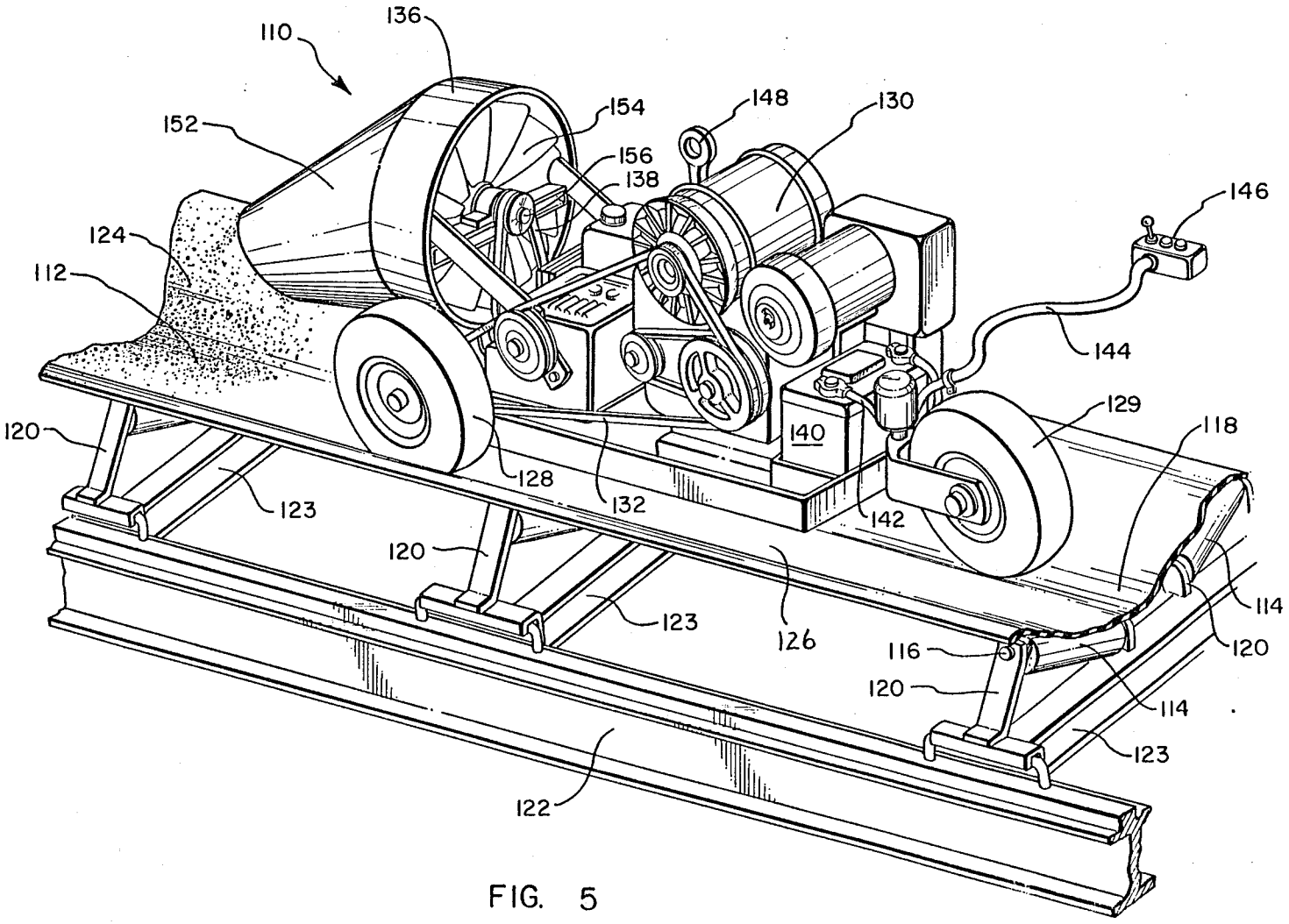
FIG. 5 is a perspective view of an additional embodiment of the apparatus in place on a mine conveyor.

FIG. 5 illustrates an additional embodiment of the present invention. The primary differences between the embodiment illustrated in FIG. 5 and the embodiment of the invention illustrated in FIGS. 1–4 are described below. In particular, the embodiment in FIG. 5 include a single front wheel 129, as opposed to two front wheels as shown in the previous embodiment. The embodiment shown in FIG. 5 may be desirable in that the single front wheel 129, in the form of a caster, may be easier to guide over the conveyor belt in certain instances in that the front wheel will follow the path of trough 18 created by the conveyor belt 12.

In addition, it will be appreciated that the device illustrated in FIG. 5 is driven by a belt drive 132, as opposed to a transmission/differential mechanism. This simply illustrates the fact that the device may be driven by any type of conventional mechanical drive mechanism.

As a further matter, it is obvious that the blower mechanism 136 is configured differently than that in the previous embodiment. In particular, the blower mechanism comprises a hood 152 which is appropriately shaped such that the air blown by the fan located within the hood exits the device in an appropriate direction.

Various other components of the device 110 and the conveyor are shown. As illustrated in the previous figures, the conveyor comprises conveyor belt 112 and idlers 114 which form a trough line 118. Idlers 114 ride on axles 116, which are in turn supported by braces 120, rails 122, and conveyor supports 123.

The device illustrated in FIG. 5 comprises diesel engine 130 which is attached to a frame 126. As with other embodiments, the apparatus 110 has two rear drive wheels 128, but only a single front wheel 129. Drive belt 132 places diesel engine 130 in communication with drive wheels 128 and the drive mechanism for the fan 154.

Fan 154 is vertically aligned on shaft 156 and is driven by belt 138. The fan produces a flow of air into blower housing 152, which in turn directs the air onto the belt 112 and the rock dust 124 disposed thereon.

As with the other embodiments various control mechanisms are possible. FIG. 5 illustrates control box 146 which is attached to the remainder of the apparatus by way of cable 144. In addition, battery 140 and cables 142 are shown.

It will be appreciated that each of the objects of the invention is accomplished using the present methods and apparatus. The present apparatus is extremely effective in spreading rock dust in that every corner of the mine served by a conveyor belt can easily be accessed and coated with rock dust. Even areas which are hard to reach using the bulky conventional apparatus containing rock dust hoppers, can easily be accessed using the present invention.

It will be appreciated that the present apparatus is extremely mobile and quick in operation. Because of the self-contained diesel engine and its relative lightweight, the apparatus 10 can be driven to any part of the mine rapidly and with little effort.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method of dispersing rock dust in a mine tunnel comprising the steps of:

(a) providing a layer of rock dust disposed upon a surface within the tunnel;

(b) providing an apparatus, said apparatus comprising means for propelling the apparatus, means for controlling the direction of travel of the apparatus, and blower means for propelling said rock dust from the surface within the tunnel in predetermined directions;

(c) controlling the direction of travel of the apparatus such that it travels over the surface supporting said rock dust; and (d) controlling said blower means such that rock dust is propelled by the apparatus from the surface toward and onto the walls of the tunnel.

2. A method of dispersing rock dust in a mine tunnel as defined in claim 1 wherein said surface comprises a portion of a conveyor belt.

3. A method of dispersing rock dust in a mine tunnel as defined in claim 2 wherein said conveyor belt comprises a conveyor belt located permanently within said tunnel.

4. A method of dispersing rock dust in a mine tunnel as defined in claim 1 wherein said mine tunnel comprises an underground coal mine.

5. A method of dispersing rock dust in a mine tunnel as defined in claim 1 wherein said means for propelling the apparatus comprises a diesel engine.

6. A method of dispersing rock dust in a mine tunnel as defined in claim 1 wherein said means for propelling the apparatus comprises an electric motor.

7. A method of dispersing rock dust in a mine tunnel as defined in claim 2 wherein said means for controlling the direction of travel of the apparatus comprises at least one front wheel which changes direction in response to the path of the conveyor belt.

8. A method of dispersing rock dust in a mine tunnel as defined in claim 1 wherein the step of controlling said blower means further comprises directing the flow of air produced by said apparatus such that said rock dust is deflected by the surface on which the rock dust is disposed such that the rock dust is directed onto the interior surfaces of the tunnel.

9. A method of dispersing rock dust in a mine tunnel as defined in claim 1 wherein said blower means comprises a fan.

10. A method of dispersing rock dust in a mine tunnel as defined in claim 9 wherein said blower means further comprises at least one air dam.

11. A method of dispersing rock dust in a mine tunnel as defined in claim 1 wherein said means for propelling the apparatus comprises a transmission and means for selectively engaging the transmission.

12. A method of dispensing rock dust in a mine tunnel as defined in claim 11 wherein said transmission further comprises a plurality of belts.

13. A method of dispersing rock dust in a mine tunnel as defined in claim 11 wherein said transmission further comprises a plurality of gears.

14. A method of dispersing rock dust in a mine tunnel as defined in claim 11 wherein the step of controlling the direction of travel of the apparatus comprises selectively engaging and disengaging the transmission.

15. A method for spreading rock dust in an underground mine, said mine having a permanent conveyor system within the mine, the method comprising the steps of:

(a) placing a substantially even layer of rock dust on the portion of the permanent conveyor which runs within the portion of said underground mine which is to be coated with rock dust;

(b) providing a rock dust spreading apparatus, said apparatus comprising self-contained engine means, a plurality of wheels, means for placing said engine means in communication with at least one of said wheels such that the wheels can be selectively rotated, blower means, means for placing said blower means in communication with said engine means such that said blower means can be selectively driven by said engine means whereby a flow of air is produced, means for directing said flow of air such that rock dust is propelled by said flow of air in a predetermined direction;

(c) placing the apparatus on the conveyor and causing the apparatus to move along the conveyor such that the apparatus travels over the rock dust; and (d) directing the blower means such that rock dust is propelled from the conveyor onto the walls of the tunnel.

16. A method of spreading rock dust in an underground mine as defined in claim 15 wherein the direction said rock dust is propelled is determined by deflection of the rock dust by the conveyor belt.

17. A method of spreading rock dust in an underground mine as defined in claim 15 wherein said engine means comprises a diesel engine.

18. A method of spreading rock dust in an underground mine as defined in claim 15 wherein said conveyor comprises a conveyor belt, said conveyor belt forming a trough.

19. A method of spreading rock dust in an underground mine as defined in claim 18 wherein the direction of travel of the apparatus follows the conveyor belt in that said apparatus is disposed within the conveyor belt trough.

20. A method of spreading rock dust in an underground mine as defined in claim 15 wherein said apparatus comprises two drive wheels, said drive wheels being placed in communication with said engine means.

21. A method of spreading rock dust in an underground mine as defined in claim 15 wherein said apparatus comprises a single front wheel.

22. A method of spreading rock dust in an underground mine as defined in claim 15 wherein said apparatus comprises two front wheels.

23. An apparatus for dispersing rock dust in an underground tunnel comprising:

a frame;

an engine securely attached to the frame;

a plurality of wheels rotatably attached to the frame;

means for placing the engine in communication with at least one of said wheels such that said wheels can be selectively rotated in order to drive the apparatus;

means for controlling the direction of travel of the apparatus; and blower means securely attached to the frame, said blower means being placed in communication with said engine and being capable of propelling rock dust in a predetermined direction such that rock dust disposed upon a conveyor belt located beneath the apparatus is propelled onto the walls of the underground tunnel.

24. An apparatus for dispersing rock dust in an underground tunnel as defined in claim 23 wherein said engine comprises a diesel engine.

25. An apparatus for dispersing rock dust in an underground tunnel as defined in claim 23 wherein said wheels comprise drive wheels and front wheels.

26. An apparatus for dispersing rock dust in an underground tunnel as defined in claim 25 wherein said means for controlling the direction of travel of the apparatus comprises attaching said front wheels to said frame in such a manner that the front wheels follow the direction of the conveyor belt.

27. An apparatus for dispersing rock dust in an underground tunnel as defined in claim 23 wherein said blower means comprises a fan.

28. An apparatus for dispersing rock dust in an underground tunnel as defined in claim 23 wherein said blower means comprises at least one air dam.

29. An apparatus for dispersing rock dust in an underground tunnel as defined in claim 23 wherein said means for placing the engine in communication with the wheels comprises a transmission.

30. An apparatus for dispersing rock dust in an underground tunnel as defined in claim 29 wherein said transmission comprises a plurality of belts.

31. An apparatus for dispersing rock dust in an underground tunnel as defined in claim 29 wherein said transmission comprises a plurality of gears.

32. A rock dusting apparatus for use in rock dusting mine tunnels containing a conveyor system, said conveyor system having a conveyor belt which forms a trough, said apparatus comprising:

a frame;

means for propelling the apparatus securely attached to said frame;

means for controlling the direction of travel of the apparatus comprising at least one wheel attached to the frame in such a manner that the wheel turns in response to the path defined by the trough of the conveyor belt; and blower means for propelling rock dust disposed on the conveyor belt onto the walls of the mine tunnel.

33. A rock dusting apparatus as defined in claim 32 wherein said means for propelling the apparatus comprises a diesel engine.

34. A rock dusting apparatus as defined in claim 32 wherein said means for propelling the apparatus comprises an electric motor.

35. A rock dusting apparatus as defined in claim 32 wherein said means for controlling the direction of travel of the apparatus comprises one front wheel which changes direction in response to the path of the conveyor belt.

36. A rock dusting apparatus as defined in claim 32 wherein said means for controlling the direction of travel of the apparatus comprises two front wheels which change direction in response to the path of the conveyor belt.

37. A rock dusting apparatus as defined in claim 32 wherein said blower means comprises a fan.

38. A rock dusting apparatus as defined in claim 37 wherein said blower means further comprises at least one air dam.

39. A rock dusting apparatus as defined in claim 32 wherein said means for propelling the apparatus comprises a transmission and means for selectively engaging the transmission.

40. An apparatus for use in rock dusting mine tunnels containing a conveyor system, said conveyor system having a conveyor belt which forms a trough, said apparatus comprising:

a frame;

a diesel engine securely attached to said frame;

two rear drive wheels rotatably attached to the frame;

at least one front wheel attached to said frame in such a manner as to change direction in response to a change in the path of the trough of the conveyor belt;

transmission means for placing the diesel engine in communication with the rear drive wheels; and blower means comprising a fan which is in communication with, and driven by, said diesel engine, said blower means further comprising at least one air dam configured such that air driven by said fan exits said blower means in a predetermined direction.

* * * * *

UNITED STATES PATENT AND TRADEMARK OFFICE

CERTIFICATE OF CORRECTION

PATENT NO. : 4,805,702

DATED : February 21, 1989

INVENTOR(S) : Earl R. White

It is certified that error appears in the above-identified patent and that said Letters Patent is hereby corrected as shown below:

Column 1, lines 35-36, "Not only is the coal itself is combustible," should be --Not only is the coal itself combustible,--

Column 1, line 59, "the combination" should be --The combination--

Column 4, line 38, "IT" should be --It--

Column 4, line 57, "which wee mobile" should be --which were mobile--

Column 12, line 38, "possibly" should be --possible--

Column 13, line 39, "its relative lightweight" should be --its relative light weight--

Signed and Sealed this

Nineteenth Day of December, 1989

*Attest:*

JEFFREY M. SAMUELS

*Attesting Officer*

*Acting Commissioner of Patents and Trademarks*